US007706956B2

(12) United States Patent
Nagase et al.

(10) Patent No.: US 7,706,956 B2
(45) Date of Patent: Apr. 27, 2010

(54) APPARATUS AND SYSTEM FOR DRIVING FUEL INJECTORS WITH PIEZOELECTRIC ELEMENTS

(75) Inventors: Noboru Nagase, Anjo (JP); Hideo Naruse, Chiryu (JP); Takashi Kikutani, Aichi-ken (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/905,149

(22) Filed: Sep. 27, 2007

(65) Prior Publication Data

US 2008/0072879 A1 Mar. 27, 2008

(30) Foreign Application Priority Data

Sep. 27, 2006 (JP) ..... 2006-262792

(51) Int. Cl.
*F02M 51/00* (2006.01)
*F02M 61/04* (2006.01)
*F02M 63/00* (2006.01)

(52) U.S. Cl. ..... 701/104; 123/494; 239/102.2

(58) Field of Classification Search ..... 123/478, 123/480, 490, 494, 498; 310/316.01, 316.03, 310/317; 239/102.02; 701/103–105
See application file for complete search history.

(56) References Cited

U.S. PATENT DOCUMENTS

| | | | | |
|---|---|---|---|---|
| 6,147,433 | A * | 11/2000 | Reineke et al. | 310/316.03 |
| 6,705,291 | B2 * | 3/2004 | Rueger et al. | 123/467 |
| 6,863,055 | B2 * | 3/2005 | Rueger | 123/478 |
| 6,973,919 | B2 | 12/2005 | Joos et al. | |
| 7,199,502 | B2 * | 4/2007 | Reggio | 310/317 |
| 7,422,005 | B2 * | 9/2008 | Hardy et al. | 123/490 |
| 2003/0218437 | A1 | 11/2003 | Bock et al. | |
| 2004/0008032 | A1 | 1/2004 | Rueger et al. | |

FOREIGN PATENT DOCUMENTS

| | | |
|---|---|---|
| DE | 100 64 790 | 6/2001 |
| DE | 1 586 760 | 10/2005 |
| EP | 1 526 587 | 4/2005 |
| FR | 2 876 740 | 4/2006 |
| JP | 05-344755 | 12/1993 |
| JP | 06-140682 | 5/1994 |
| JP | 06-177449 | 6/1994 |
| JP | 06-264805 | 9/1994 |
| JP | 2002-136156 | 5/2002 |
| JP | 2003-120384 | 4/2003 |
| JP | 2005-127163 | 5/2005 |
| JP | 2005-130561 | 5/2005 |

OTHER PUBLICATIONS

Official communication issued May 20, 2009 in corresponding European Application No. 07018742.2-1263.

* cited by examiner

*Primary Examiner*—Stephen K Cronin
*Assistant Examiner*—Johnny H Hoang
(74) *Attorney, Agent, or Firm*—Nixon & Vanderhye P.C.

(57) ABSTRACT

An apparatus is provided for driving an injector injecting fuel into an internal combustion engine. The injector is provided with a piezoelectric element to be charged and discharged. The apparatus comprises a calculator and a charger. The calculator calculates a command value to charge the piezoelectric element. The calculator includes correcting means that corrects the command value based on information indicating either an operation of the piezoelectric element or an electric characteristic of the apparatus. The charger charges the piezoelectric element in response to the corrected command value to accumulate a desired amount of electric energy at the piezoelectric element.

10 Claims, 8 Drawing Sheets

APPARATUS AND SYSTEM FOR DRIVING FUEL INJECTORS WITH PIEZOELECTRIC ELEMENTS

CROSS REFERENCE TO RELATED APPLICATION

The present application relates to and incorporates by reference Japanese Patent application No. 2006-262792 filed on Sep. 27, 2006.

BACKGROUND OF THE INVENTION

1. Field of the Invention

The present invention relates to an apparatus and a system both for driving fuel injectors that have piezoelectric elements, and, in particular, to the apparatus and the system that are preferably adapted to vehicles with diesel engines serving as drive sources.

2. Description of the Related Art

An apparatus for driving injectors of a diesel engine, i.e., an injector driving apparatus, is provided with a power source composed of such members as a DC-DC converter and a charge unit charging piezoelectric elements based on the power from the power source. The power source receives voltage (12V) from a battery to boost it up to a higher voltage of several dozens to several hundreds volts. The charge unit receives the boosted higher voltage to charge the piezoelectric elements by causing current to repeatedly flow from the power source to the piezoelectric elements for a specific period of time. This way of charging the piezoelectric elements is exemplified by Japanese Patent Laid-open Publication No. 2002-136156.

However, the injectors are manufactured to perform fuel injection every time an injector is charged with energy of a given level or more. The energy E charged by a piezoelectric element can be expressed by a formula of "$E=(1/2)(CV^2)$," where C is a capacitor of the piezoelectric element and V is a voltage to be applied to the piezoelectric element.

In recent years, to reduce harmful substances contained in exhaust gas, it is absolutely necessary to precisely control the intervals of fuel injection. This way of fuel injection control increases the number of times of operating the injectors (i.e., fuel injection number).

In this apparatus, the voltage of the power source will decrease due to charging the piezoelectric elements, and will not be restored to its original value until a predetermined period of time passes.

Hence, when an interval of time between adjacent fuel injection operations of each injector becomes smaller so as to provide "successive (or nearly contiguous)" injecting operations, the voltage of the power source may not be restored to its original value. If such a case happens, as apparent from the foregoing formula, the amount of electric energy accumulated in each piezoelectric element is forcibly smaller than a voltage which is a control target value for the injector driving apparatus.

In the following description, the "successive fuel injection" means that each injector injects the fuel successively a plurality of times during one air-intake stroke carried out by each cylinder of the internal combustion engine. When this "successive fuel injection" causes a shortage in the charged energy compared to its target value, this is called "influence of the successive fuel injection."

Further, the capacitance of the piezoelectric element fluctuates depending on the temperature. Such fluctuations will also cause a problem that, as apparent from the foregoing formula, the amount of electric energy accumulated in the piezoelectric element is deviated from its target value.

In addition, it is inevitable that products of the injectors and injector driving apparatus have fluctuations of performances (i.e., individual differences). This problem may also result in a deviation, from its target value which needs to be controlled, of the amount of electric energy accumulated in each piezoelectric element by the injector driving apparatus.

The above situations may cause a problem in that the amount of fuel injected by each injector also deviates from a desired amount to be injected.

SUMMARY OF THE INVENTION

The present invention has been made in consideration of the foregoing situations, and it is an object of the present invention to improve accuracy of the fuel injection from each injector.

In order to achieve the above object, the present invention provides, as one aspect thereof, an apparatus for driving an injector injecting fuel into an internal combustion engine, the injector being provided with a piezoelectric element to be charged and discharged, the apparatus comprising: a calculator that calculates a command value to charge the piezoelectric element, wherein the calculator includes correcting means that corrects the command value based on information indicating either an operation of the piezoelectric element or an electric characteristic of the apparatus; and a charger that charges the piezoelectric element in response to the corrected command value to accumulate a desired amount of electric energy at the piezoelectric element.

Preferably, the information indicates the operation of the piezoelectric element and the apparatus further comprises an acquiring unit that acquires, as the information, information indicating at least one of a capacitance of the piezoelectric element and a voltage applied to the piezoelectric element.

Still preferably, the charger includes an on/off type of switch that is switched "on" when the piezoelectric element is charged and the command value is a duration during which the switch is in an on-state thereof.

It is preferred that the correcting means is adapted to increase the command value so as to cancel an influence of successive fuel injection carried out by the injector.

Alternatively, for example, the information is information indicating a characteristic of the apparatus.

As described above, the command value is corrected on the basis of information indicating either an operation of the piezoelectric element or an electric characteristic of the apparatus. It is therefore possible to charge the piezoelectric element so that, even if the capacitance of the piezoelectric element and/or the voltage applied to the piezoelectric element fluctuate, an amount of electric energy actually accumulated (charged) at the piezoelectric element does not differ from the command value, that is, a target amount of electric energy to be accumulated at the piezoelectric element.

Alternatively, the command value can also be corrected based on the information indicating a characteristic of the apparatus. Thus, even if there are irregularities in the characteristics of products (individual differences), the amount of electronic energy accumulated at the piezoelectric element can be controlled to a target command value in a precise manner.

Accordingly, the amount of fuel injected actually from the injector becomes equal or almost equal to a target amount of fuel to be injected, providing a more precise fuel injection.

DETAILED DESCRIPTION OF PREFERRED EMBODIMENTS

Various embodiments of the present invention will now be described with reference to the accompanying drawings. Those embodiments will be described as a case where the present invention is applied to an injector driving apparatus being mounted on a vehicle.

First Embodiment

Figure 1:
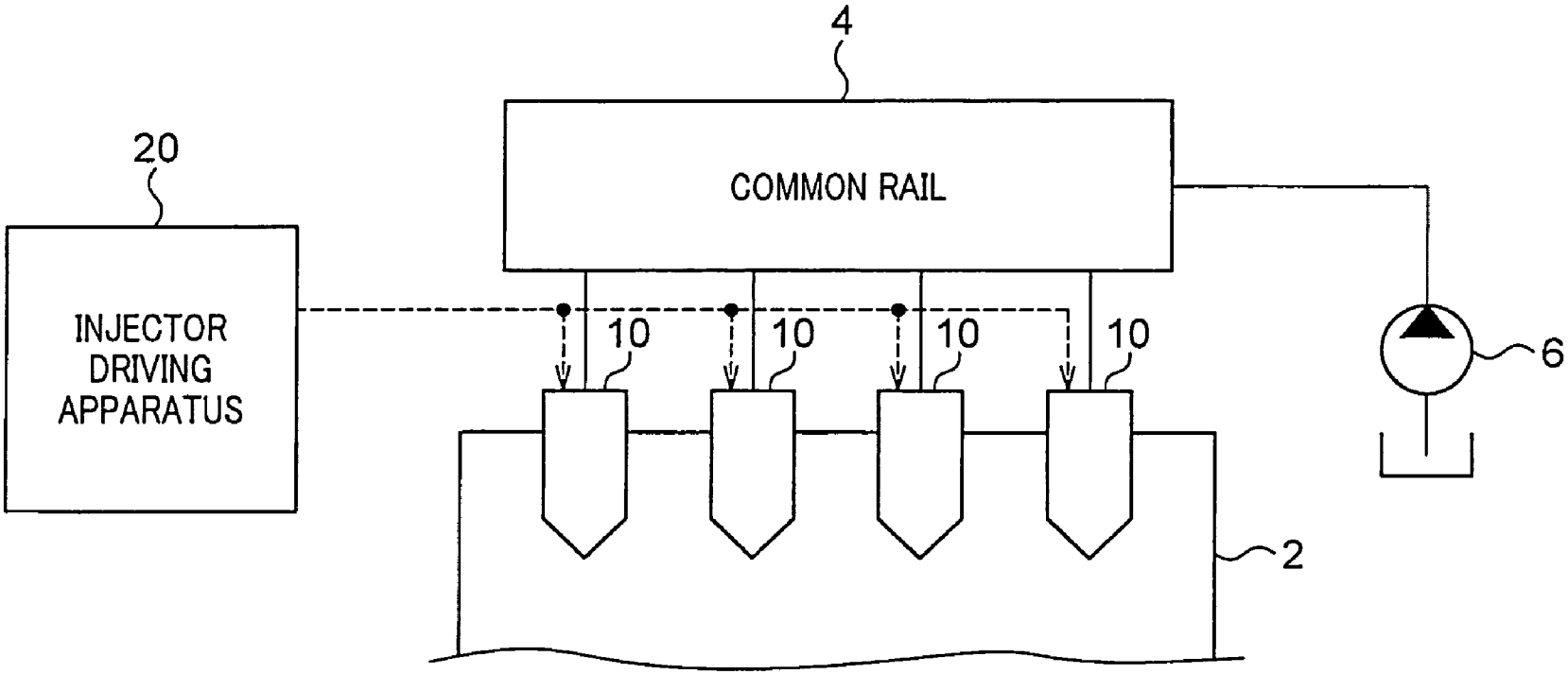
FIG. 1 is a block diagram outlining the configuration of an injector driving system according to a first embodiment of the present invention.

Referring to FIGS. 1-6A, 6B, a first embodiment of the present invention will now be described. FIG. 1 outlines the confirmation of an injector driving system according to the first embodiment, while FIG. 2 details the electric configuration of the injector driving system.

As shown in FIG. 1, this injector driving system is mounted on a vehicle, where there is provided a common-rail type of 4-cylinder diesel engine 2 (hereinafter, simply referred to as an "engine") which is driven by the injector driving system. The injector driving system is provided with injectors 10 to provide fuel to the engine 2 in an injecting manner and an injector driving apparatus 20 to drive the injectors 20 by charging and discharging a piezoelectric element P (refer to FIG. 2) mounted in each injector 10.

Figure 2:
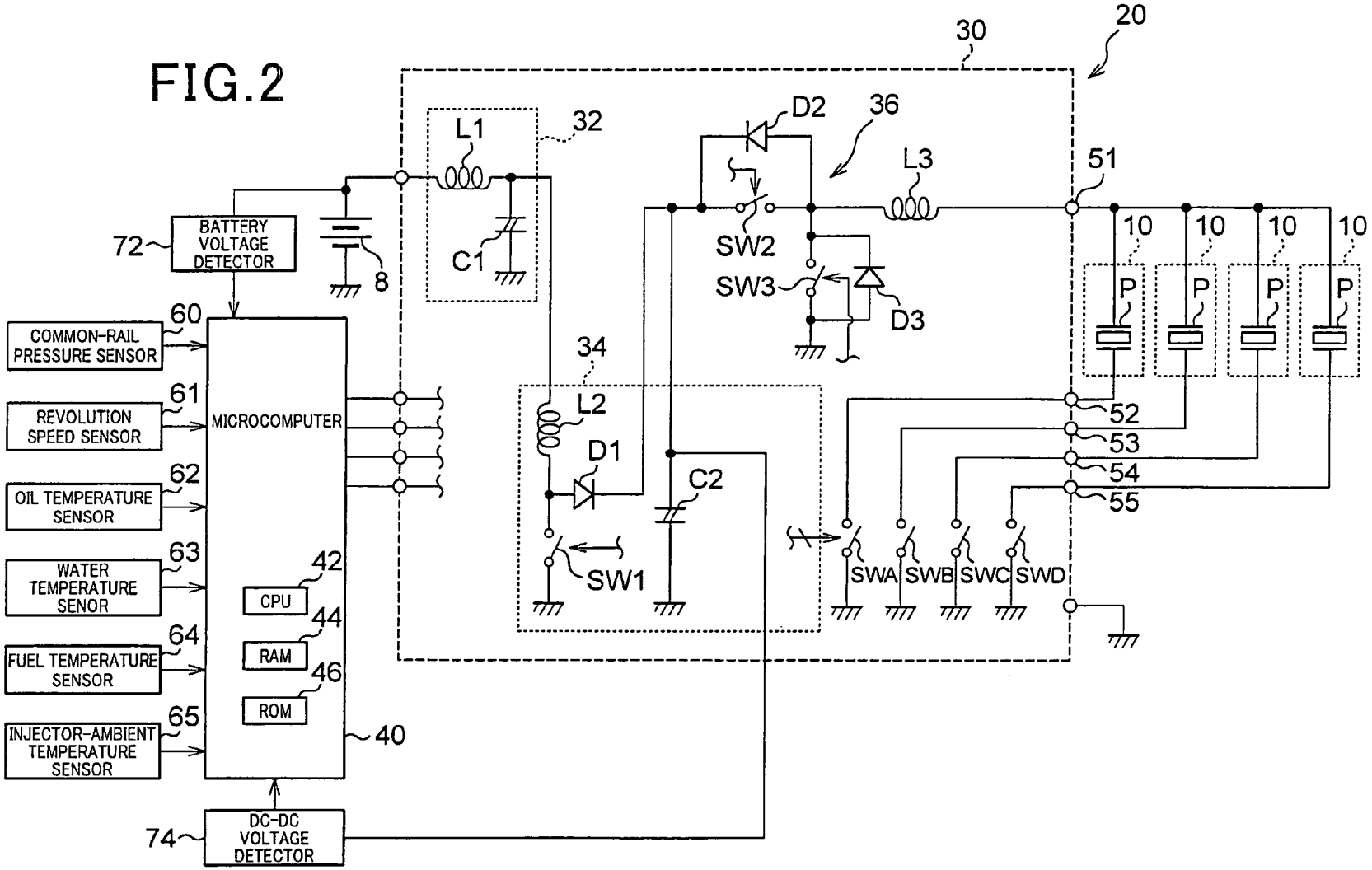
FIG. 2 is a circuit diagram showing the injector driving system.

The "common rail" 4 is a piping in which fuel is accumulated at a high pressure so that the high-pressure fuel is supplied to the respective injectors 10 of the cylinders. In addition, the "common rail type" is a technique of preserving in the common rail 4 the fuel highly pressurized by a high-pressure pump 6 and then injecting the high-pressure fuel into the combustion chambers of the engine 2 by opening the valve of each injector 10 at given timings The injectors 10 are disposed at the cylinders of the engine 2, respectively, and as shown in FIG. 2, are produced to be able to inject fuel in response to the expanding and shrinking operations of each of piezoelectric elements P.

Each piezoelectric element P is produced to expand responsively to be charged with energy (on electric charge) supplied from the injector deriving apparatus 20 and shrink responsively to releasing the charged energy. Each piezoelectric element P has both ends as shown in FIG. 2 and one of both ends is electrically connected to one end of a charging/discharging coil L3 described later, while the other of both ends is electrically connected to the ground via cylinder selecting switches SWA-SWD described later.

On the outer surface of each injector 10, there are provided pieces of code information on a QR (quick response) code (registered trademark) and bar codes, and others. The code information includes wiring information indicative of both an inductance value and a resistance value of a wire connected between a later-described EDU (electronic driver unit) 30 and each injector 10, capacitance information indicative of a capacitance value of each piezoelectric element P, and resistance information indicative of a resistance value of a serially disposed internal resistance in each injector 10.

In the present embodiment, when the injectors 10 are dispatched from a manufacture's factory, the capacitance information and the resistance information are measured to produce the code information including the measured results. In a state where the injectors 10 are connected to the injector driving apparatus 20, the wiring information is measured to be transformed into the code information including the measured results.

When being dispatched, the produced code information is read by a reader to store the read-out information in a ROM 46 of a microcomputer 40 which will be described.

The injector driving apparatus 20 is provided with an EDU (electronic driver unit) 30 driving the injectors 10 and a microcomputer 40 driving the EDU 30 in a controlled manner.

The EDU 30 is for driving the injectors 10 by charging and discharging the respective piezoelectric elements P and provided with a filter (filtering circuit) 32, a DC-DC converter 34, and a charging/discharging switch 36.

The filter 32 is a known LC filter composed of a filtering coil L1 and a filtering capacitor C1. The filtering coil L1 has two ends, one end of which is electrically connected to a positive-pole side terminal of a battery mounted on the vehicle and the other end is electrically connected to the DC-DC converter 34.

The filtering capacitor C1 also has two ends, in which one end is grounded, while the other end is electrically connected to a connecting point at which the filtering coil L1 and the DC-DC converter 34 are electrically linked to each other.

The DC-DC converter 34, which serves as a power source circuit supplying electric power to the respective piezoelectric elements P, produces a voltage signal of which voltage the value is higher than the terminal voltage of the battery 8 (in the present embodiment, a voltage signal of several dozen—several hundred volts (v) is produced). This DC-DC converter 34 is provided with various elements such as a booster cool L2, a booster switch SW1, a DC-DC capacitor C2, and a discharge-preventing diode D1. One end of the boosting coil L2 is electrically connected to the filtering coil L1 of the filter 32, while the other end thereof is grounded via the boosting switch SW1.

The boosting switch SW1 is electrically connected to the boosting coil L2 via a connecting point, to which the anode of the discharge-preventing diode D1 is also electrically connected. The cathode of this diode D1 is electrically connected to the charging/discharging switch 36.

In addition, the charging/discharging switch 36 is electrically connected to the discharge-preventing diode D1 via a connecting point, which is also electrically connected to one end of the DC-DC capacitor C2. The other end of this capacitor C2 is electrically connected to the ground.

With the configuration stated above, the DC-DC converter 34 is able to allow the boosting switch SW1 to turn on/off repeatedly in reply to a not-shown boosting controller. This turning-on/off operation enables electric energy to be accumulated in the boosting coil L2, so that the accumulated energy is supplied to the DC-DC capacitor C2.

The charging/discharging switch 36 is placed to control electric energy to charge the piezoelectric elements P and is equipped with a charging switch SW2, a discharging switch SW3, a regenerating diode D2, a flywheel diode D3, a charging/discharging coil L3, and cylinder selecting stitches SWA-SWD.

The charging switch SW2 is an electrical on/off switch having two ends, where one end is electrically connected to a cathode of the discharge-preventing diode D1 and the other end is electrically connected to one end of the charging/discharging coil L3. The other end of this coil L3 is electrically connected to the respective piezoelectric elements P of the injectors 10 via an output terminal 51 of the EDU 30.

A connecting point connects the charging switch SW2 and the charging/discharging coil L3. This connecting point is also electrically connected to the anode of the regenerating diode D2 and the one end of the discharging switch SW3. The cathode of the regenerating diode D2 is electrically connected to a connecting point connecting the charging switch SW2 and the discharge-preventing diode D1, while the other end of the discharging switch SW3 is grounded.

The flywheel diode D3 is connected in parallel to the discharging switch SW3 so as to have the anode of this diode D3 grounded.

The cylinder selecting switches SWA-SWD are for selecting one of the injectors 10 mounted to the engine, cylinder by cylinder, which selected one is to be driven. The cylinder selecting switches SWA-SWD are the same in number as those of the cylinders of the engine 2. In the present embodiment, the number is four.

As shown in FIG. 2, each of the cylinder selecting switches SWA-SWD has two ends, one of which is grounded and the other is electrically connected to the piezoelectric element P of each corresponding injector 10 via a terminal 52 (to 55) of the EDU 30.

The microcomputer 40 includes a CPU (central processing unit) 42, a RAM 44, and a ROM 46, in which the CPU 42 performs various processes on predetermined programs stored beforehand in the ROM 46. Such processes include replies to fuel injection commands issuing from a not-shown electronic control unit controlling the operations of the engine 2. Practically, as one mode of its operations, the CPU 42 turns on/off both the charging switch SW2 and the discharging switch SW3 in a controlled manner, that is, controls the charging/discharging operations of the piezoelectric elements P.

As another mode of the operations, the microcomputer 40, i.e., the CPU 42 corrects a switch-on time at which the charging switch SW2 is switched on, when the microcomputer 40 controls the charging operations of the piezoelectric elements P. This correcting operation is done such that the piezoelectric elements P accumulates the desired amount of energy, based on the capacitances of the piezoelectric elements P and fluctuations in the voltages applied to the piezoelectric elements P as well as individual differences in the electric characters of both the injector driving apparatus 20 and the injectors 10.

In order to achieve the above operations, the microcomputer 40 accepts signals detected by a common-rail pressure sensor 60, a revolution speed sensor 61, an oil temperature sensor 62, a water temperature sensor 63, a fuel temperature sensor 64, an injector-ambient temperature sensor 65, and other members. The common-rail pressure sensor 60 is formed and placed to detect the pressure of the common rail 4 and outputs a signal indicative of the detected pressure value. The revolution speed sensor 61 is formed and placed to detect the revolution speed of the engine 2 so that this sensor 61 outputs a signal indicative of the detected revolution speed. The oil temperature sensor 62 is formed and arranged to detect the temperature of the oil of the engine 2 and outputs a signal indicative of the detected oil temperature.

Further, the water temperature 63 is formed and arranged to detect the temperature of the water of the engine 2 and outputs a signal indicative of the detected water temperature. The fuel temperature sensor is formed and disposed to detect the temperature of the fuel and outputs a signal indicative of the detected fuel temperature. The injector-ambient temperature sensor 65 is formed and arranged at a predetermined location ambient the injectors to detect the environmental temperature ambient the injectors 10.

In addition to the above detected signals, the microcomputer 40 is formed to accept signals from a battery voltage detector 72 and a DC-DC voltage detector 74. The battery voltage detector 72 is formed to detect as a battery voltage the terminal voltage of the battery 8 and outputs a signal indicating the detected terminal voltage. Likewise the DC-DC voltage detector 74 detects the voltage of the DC-DC converter 34 and outputs a signal indicating the detected voltage.

Further, in the ROM 46 of the microcomputer 40, maps are calculated for calculating information showing capacitance, resistance and wiring, and a switch-on time of the charging switch SW2 (refer to FIGS. 4 and 5).

The operations of the injector driving system will now be outlined.

In this injector driving system, for injecting the fuel, a fuel injection signal to specify one injector among the four injectors 10 is issued by the microcomputer 40 and sent to the EDU 30. The specified injector 10 is in charge of injecting the fuel.

When the EDU 30 receives the fuel injection signal, the EDU 30 interprets the received signal and selectively turns on one of the cylinder selecting switches SWA-SWD, which selected one cylinder is specified by the incoming fuel injection signal. In a state where any cylinder selecting switch SWA (-SWD), which is specified for the selection, is switched off, the discharging switch SW3 is kept to be switched off, during which time the charging switch SW2 is made to turn on/off repeatedly.

Hence, in the above switching condition, switching on the charging switch SW2 enables the DC-DC capacitor C2 to supply current to the selected (specified) piezoelectric element P and accumulate electric energy in the charging/discharging coil L3. In contrast, in this condition, switching off the charging switch SW2 allows the charging/discharging coil L3 to release the accumulated electric energy there as a current supplied to the piezoelectric element P. As a result, the selected piezoelectric element P is charged with the current on the accumulated electric energy, whereby the piezoelectric element P is expanded to star injecting the fuel.

In the present embodiment, the EDU 30 operates to switch on the charging switch SW2 during only a period of time (the "on" period) specified by the microcomputer 40, and then switch off the charging switch SW2 on completion of elapse of the "on" period). After the charging switch SW2 is switched off, a not-shown resistor is used by the microcomputer 40 to detect that there is current passing through the selected piezoelectric element P. In response to this detection, the EDU 30 responds to the "on" period set by the microcomputer 40 so that the charging switch SW2 is switched on again during the "on" period.

When there is fuel injection signal inputted, the EDU 30 switches off the charging switch SW2, and in this switched-off state, the EDU 30 switches on/off the discharging switch SW3 repeatedly.

Thus, when the discharging switch SW3 is in its "on" state, current flows from the positive terminal side of the piezoelectric element P to the charging/discharging coil L3, so that electromagnetic energy is accumulated in this coil L3. In contrast, when the discharging switch SW3 is in its off state, the accumulated energy in the charging/discharging coil L3 allows a current to flow through the DC-DC capacitor C2 as a regenerative current. In this way, the electromagnetic energy accumulated in the piezoelectric element P is discharged, thereby causing the piezoelectric element P to shrink so as to stop the fuel injection.

Figure 3:
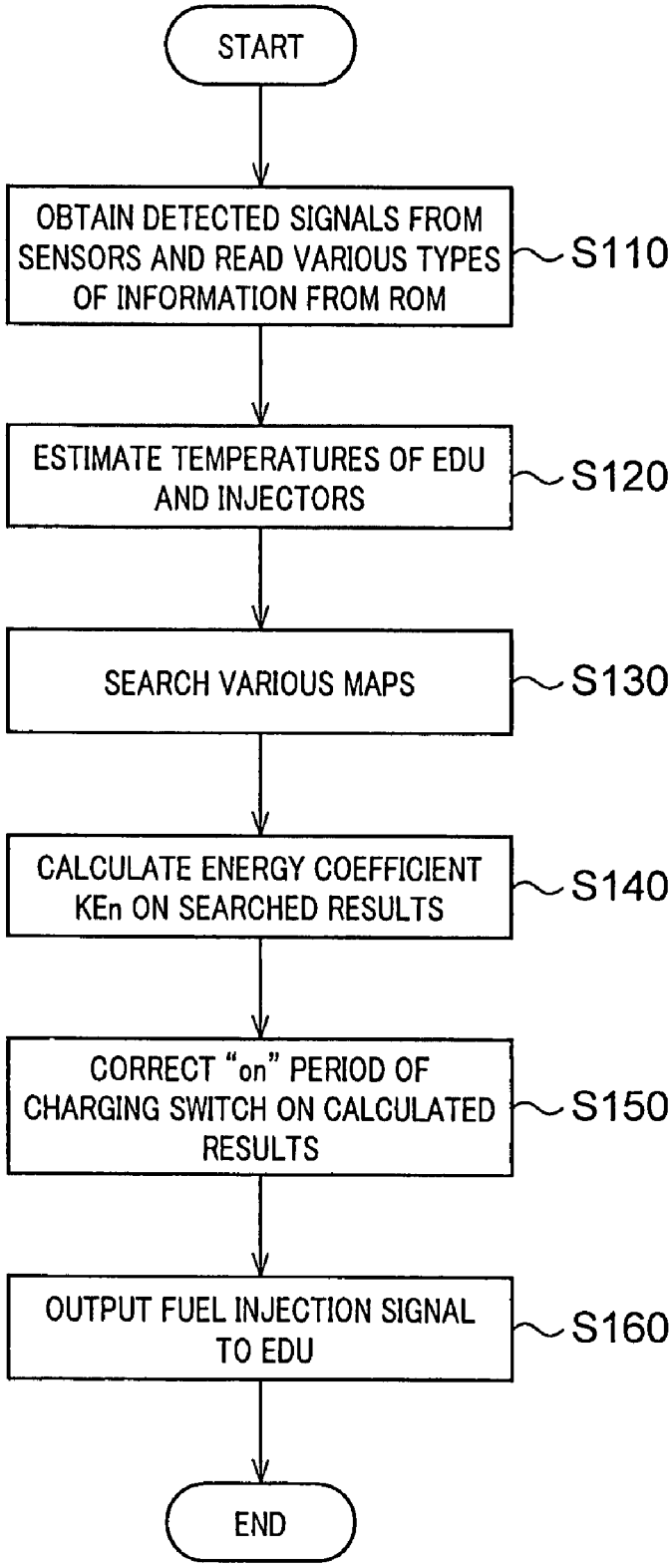
FIG. 3 is a flowchart showing processing for controlling an EDU when a microcomputer charges piezoelectric elements in the first embodiment.

FIG. 3 is a flowchart showing the processing executed by the CPU 42 of the microcomputer 30 to drive the EDU 30 in a controlled manner, when the piezoelectric element P is charged. The processing shown in FIG. 3 is activated in response to the power "on" of the on-vehicle power source.

Prior to the description of the control processing shown in FIG. 3, maps used for this control will now be described with reference to FIGS. 4 and 5. These maps are memorized as data tables, for example, in the ROM 46 of the microcomputer 40 in advance. Instead of the maps, formulas may be memorized for computation at the CPU 42.

Figure 4A:
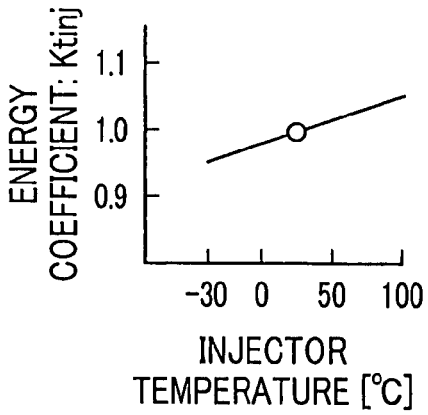
FIGS. 4A-4F are graphs respectively showing an injector temperature map, an EDU temperature map, a battery voltage map, a DC-DC voltage map, a successive injection number-of-times map, and an interval map in the first embodiment.

FIG. 4A shows an injector temperature map regulating the relationship between temperatures of each injector 10 and electric energy to be charged into each piezoelectric element P. As shown in this injector temperature map of FIG. 4A, a coefficient, called "injector-temperature-related energy coefficient (Ktinj)" in this embodiment, for correcting the "on" period of the charging switch SW2 is set to increase depending on an increase in the temperature of the injector 10. This relationship between the temperature and the coefficient (Ktinj) is decided such that the higher the temperature of the injector 10, the longer the "on" period to be given to the charging switch SW2.

Figure 4B:
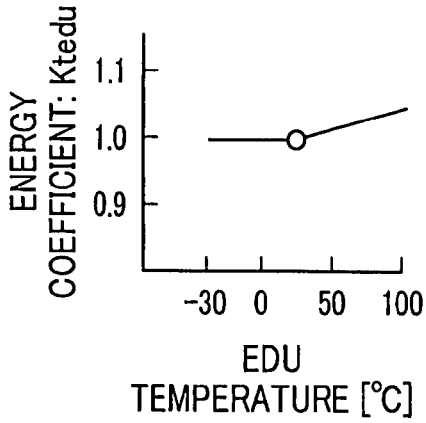

FIG. 4B shows an EDU temperature map regulating the relationship between temperatures of the EDU 30 and electric energy to be charged into each piezoelectric element P. As shown in this EDU temperature map of FIG. 4B, a coefficient, called "EDU-temperature-related energy coefficient (Ktndu)" in this embodiment, for correcting the "on" period of the charging switch SW2 is set to increase depending on fluctuations in the temperature of the EDU 30. This relationship between the temperature and the coefficient (Ktedu) is decided such that the "on" period of the charging switch SW2 becomes longer when the temperature of the EDU 30 is higher than a predetermined temperature.

Figure 4C:
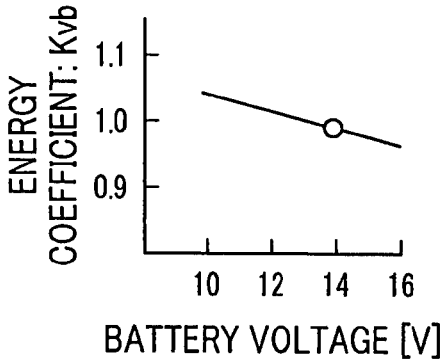

FIG. 4C shows a battery voltage map regulating the relationship between voltages of the battery 8 and electric energy to be charged into each piezoelectric element P. As shown in this battery voltage map of FIG. 4C, a coefficient, called "battery-voltage-related energy coefficient (Kvb)" in this embodiment, for correcting the "on" period of the charging switch SW2 is set to increase depending on fluctuations in the voltage of the battery 8. This relation shows that, the lower the voltage of the battery 8, the longer the "on" period of the charging switch SW2.

Figure 4D:
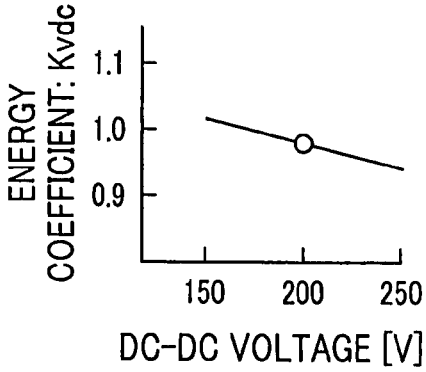

FIG. 4D shows a DC-DC voltage map regulating the relationship between the voltages of the DC-DC converter 34 and electric energy to be charged into each piezoelectric element P. As shown in this DC-DC voltage map of FIG. 4D, another coefficient, called "converter-voltage-related energy coefficient (Kvdc)" in the embodiment, for correcting the "on" period of the charging switch SW2 is set to increase depending on fluctuations in the voltage of the battery 8. This relation shows that, the lower the voltage of the DC-DC converter 34, the longer the "on" period of the charging switch SW2.

Figure 4E:
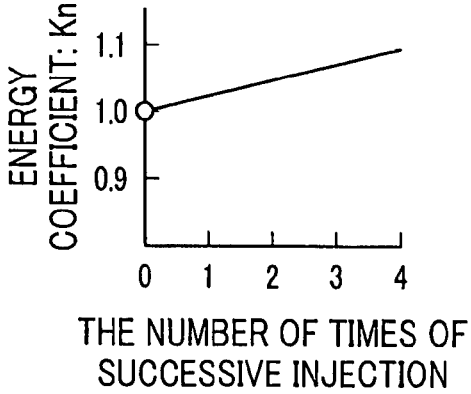

FIG. 4E shows a successive injection number-of-times map regulating the relationship between the number of times of injection performed successively and electric energy to be charged into each piezoelectric element P. As shown in this successive injection map of FIG. 4E, another coefficient, called "successive-injection-related energy coefficient (Kn)" in the embodiment, for correcting the "on" period of the charging switch SW2 is set to increase depending on the number of times of successive injection. This relation shows that, the greater the number of successive injection times, the longer the "on" period of the charging switch SW2.

Figure 4F:
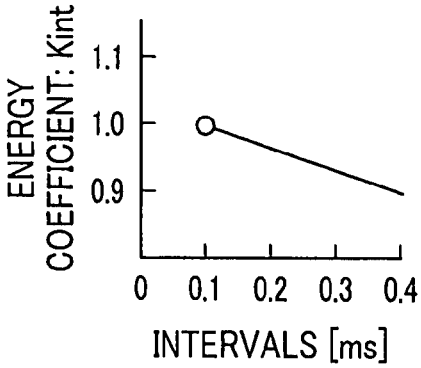

FIG. 4F shows an interval map regulating the relationship between an interval of time between two adjacent fuel-injecting operations (i.e., fuel injection interval) and electric energy to be charged into each piezoelectric element P. As shown in this interval map of FIG. 4F, another coefficient, called "interval-related energy coefficient (Kint)" in the embodiment, for correcting the "on" period of the charging switch SW2 is set to increase depending on the fuel injection intervals. This relation shows that, the shorter the fuel injection intervals, the longer the "on" period of the charging switch SW2.

Figure 5A:
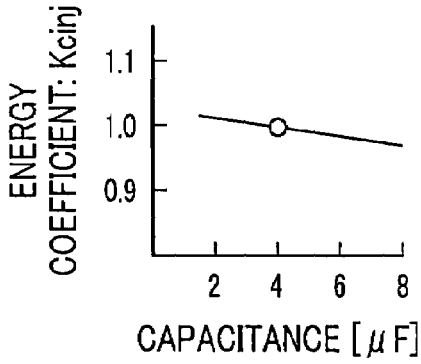
FIG. 5A-5D are graphs respectively showing a capacitance map, a resistance map, a wire map, and an EDU command map in the first embodiment.

Furthermore, FIG. 5A shows a capacitance map regulating the relationship between capacitances of the piezoelectric element P and electric energy to be charged into each piezoelectric element P. As shown in this capacitance map of FIG. 5A, another coefficient, called "interval-related energy coefficient (Kcinj)" in the embodiment, for correcting the "on" period of the charring switch SW2 is set to increase depending on the capacitances. This relation shows that, the smaller the capacitance of the piezoelectric element P, the longer the "on" period of the charging switch SW2.

Figure 5B:
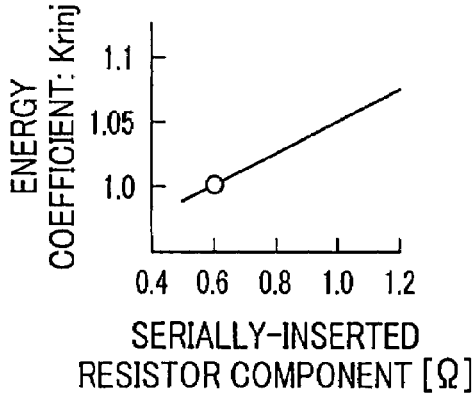

FIG. 5B shows a resistance map regulating the relationship between resistances of a serially inserted internal resistance component in the injector 10 and electric energy to be charged into each piezoelectric element P. As shown in this resistance map of FIG. 5B, another coefficient, called "resistance-related energy coefficient (Krinj)" in the embodiment, for correcting the "on" period of the charring switch SW2 is set to increase depending on the resistances. This relation shows that, the larger the resistance component, the longer the "on" period of the charging switch SW2.

Figure 5C:
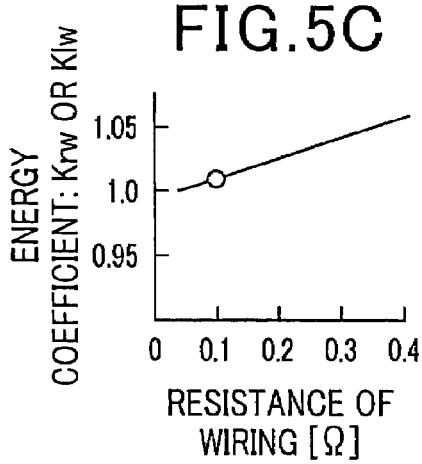

FIG. 5C shows a wire map regulating the relationship between resistance and inductance components of wires connecting the EDU 30 and the injectors 10 and electric energy to be charged into each piezoelectric element P. As shown in this wire map of FIG. 5C, another coefficient, called "wire-related energy coefficients (Krw, Klw)" in the embodiment, for correcting the "on" period of the charging switch SW2 is set to increase depending on wire characteristic information. This relation shows that, the larger the resistance and inductance components, the longer the "on" period of the charging switch SW2.

Figure 5D:
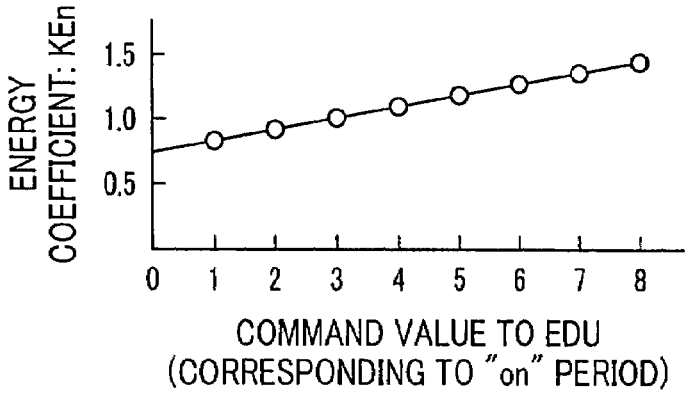

FIG. 5D shows an EDU command map regulating the relationship between "on" periods of the charging switch SW2 and electric energy to be charged into each piezoelectric element P. As shown in this EDU command map, a command regulating the "on" period of the charging switch SW2, which is given to the EDU 30, is regulated. The command is set in eight steps, which are converted into corresponding eight "command-related coefficients (Ken)."

The control flow shown in FIG. 3 will now be detailed, which is executed by the microcomputer 40, i.e., the CPU 42.

When the power is made "on," the control flow shown in FIG. 3 is activated. In reply to this activation, the microcomputer 40 acquires various detected signals coming from the various sensors 60-65 and signals from the battery voltage detector 72 and the DC-DC voltage detector 74, and reads in from the ROM 46 various types of information (step S110). Such read-in information includes information (normal operation number-of-times information) indicating the number of times of normal operations, which expresses the number of times at which each injector 10 operates per unit time; interval information indicating intervals between two adjacent fuel injection operations of each injector 10; information (successive injection number-of-times information) inactive of the number of times on which each injector 10 operates successively or successively (i.e., the number of times of successive injection (or mutually-close injection)) to inject the fuel; information about the capacitance; information about the resistance; and information about the wires.

In this specification, the term "successive" is used to mean that the injector 10 operates successively (or considerably closely) a plurality of times during one air-intake stroke carried out by each cylinder of the internal combustion engine.

After reading in the various signals and the various pieces of information at step S110, those detected signals and the normal operation number-of-times information are used to estimate the temperatures of the injectors 10 and EDU 30 (step S120).

It is considered that the temperatures of the injectors 10 and EDU 10 increases with an increase in the number of times of fuel injection at each injector 10.

In practice the estimation at step S120 is carried out such that the number of times of the fuel injection which has been executed by the injectors 10 since the start of the engine 2 is multiplied by a previously given proportional constant "k." This multiplication leads to estimating an increase in the temperature of the injectors 10 and EDU 30. Thus the estimated temperature increase is added to detected temperatures by the temperature sensors 62-65, thereby leading to the current temperatures of the injectors 10 and EDU 30.

In the present embodiment, the proportional constant "k" is a function expressed by a reciprocal number of a time of period lasting until saturation of temperatures of the injectors 10 and EDU 30.

Following the temperature estimation of the injectors 10 and EDU 30 at step S120, the estimated temperatures, signals detected by the battery voltage detector 72 and DC-DC voltage detector 74, successive injection number-of-times information, interval information, capacitance information, resistance information, and wire information are used to search the INJECTOR TEMPERATURE MAP,EDU TEMPERATURE MAP, battery voltage map, DC-DC VOLTAGE MAP, successive injection number-of-times map, interval map, capacitance map, resistance map, and wire map (S130).

Then at step S140, the searched results are summed up, and the summed amount is multiplied by the given coefficient "K" so that an energy coefficient KEn is calculated on a formula of:

$$KEn=K\times(Ktinj+Ktedu+Kvb+Kvdc+Kn+Kint+Kcinj+Krinj+Krw+Klw.$$

This calculation of the energy coefficient KEn is followed by searching the EDU command map shown in FIG. 5D (step S150). This map shows individual differences of the EDU 30. That is, at this step S150, the calculated energy coefficient KEn at step S140 is made reference to the EDU command map to select any one of the eight-step "on" periods depending on the energy coefficient KEn.

For example, if the energy coefficient KEn is 1.0, the command value is selected as 3 and if the energy coefficient KEn is 1.1, the command value is selected as 4. Thus, the "on" period of the switching switch SW2In is corrected for the next fuel injection. In the present embodiment, the larger the energy coefficient KEn, the longer the command value, i.e., the "on" period of the charging switch SW2.

On completion of newly setting the corrected "on" period for the charging switch SW2, the microcomputer 40 outputs the fuel injection signal (step S160), before ending the control processing. In reply to the newly outputted fuel injection signal, the EDU 30 drives the injectors 10, with the fuel injection carried out on the new corrected "on" period.

Figure 6A:
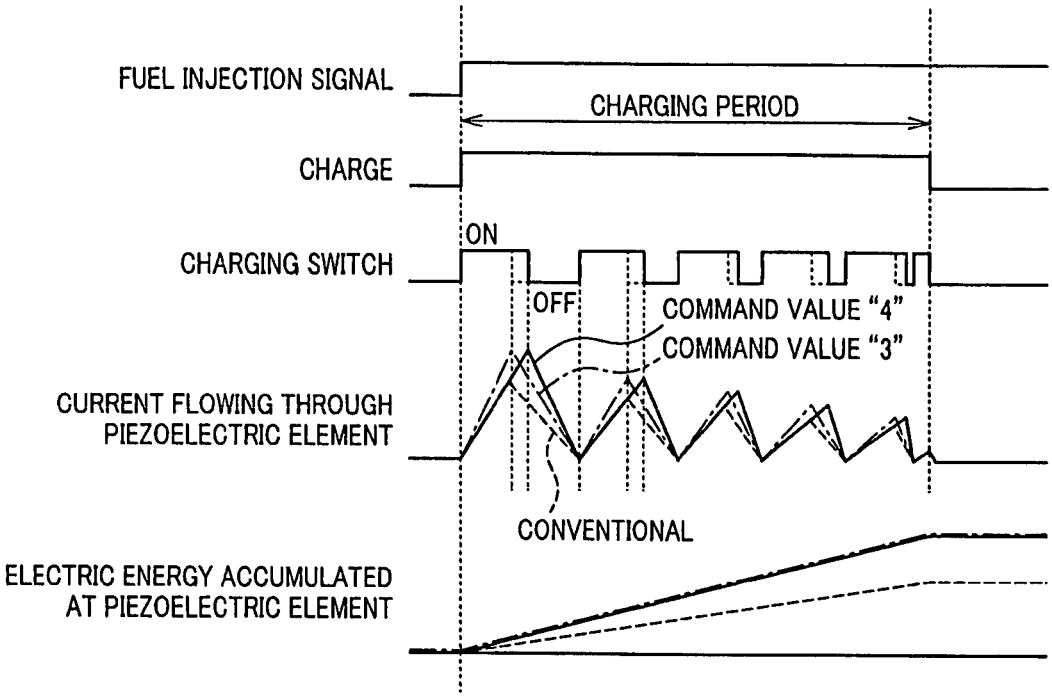
FIGS. 6A and 6B are time charts each explaining the operations of the injector driving system in the first embodiment.
Figure 6B:
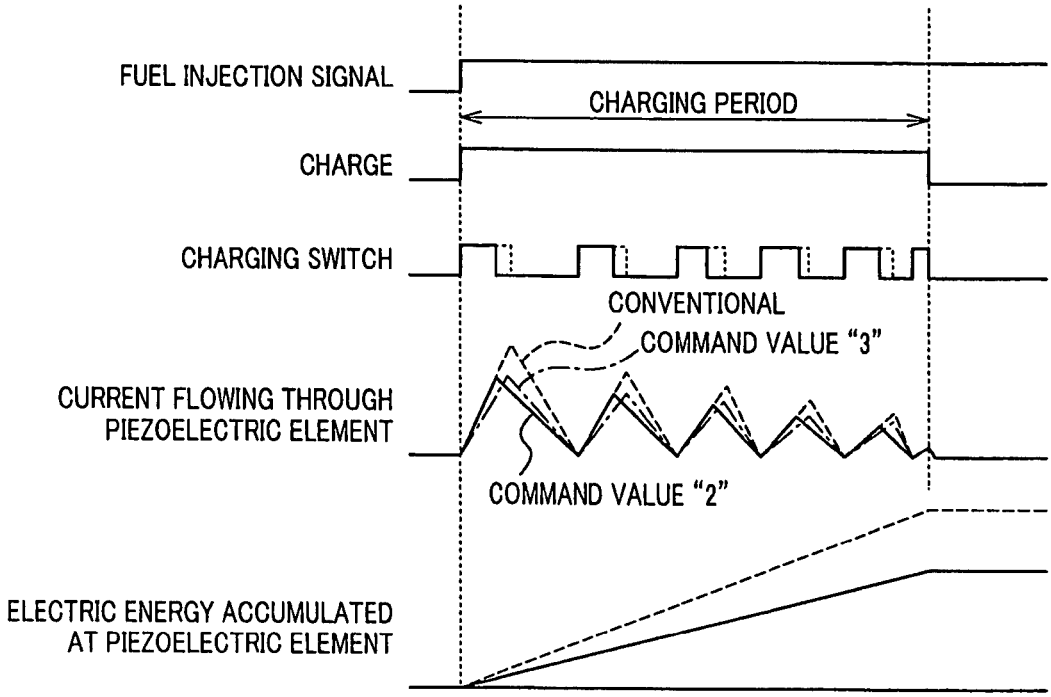

FIGS. 6A and 6B show operative timing of the injector driving system according to the present embodiment.

To be specific, in the third level in FIG. 6A, a solid line shows a case where the energy coefficient KEn is 1.1, which corresponds to a command value "4" to the EDU 30; a dashed-dotted line shows a case where the energy coefficient KEn is 1.0, which corresponds to a command value "3"; and a dotted line shows the case for the conventional injector driving system.

In the third level in FIG. 6B, a solid line denotes a case where the energy coefficient KEn is "0.9", which corresponds to a command value "2" to the EDU 30. The dashed-dotted line and dotted line shown in FIG. 6B denote the same cases as those in FIG. 6A.

As denoted by the dotted lines in FIGS. 6A and 6B, the conventional system is given a fixed "on" period of the charging switch SW2 in any condition. Thus it is not always true that the piezoelectric elements are charged with a desired electric amount. Thus, it is frequent that the amount of the energy to be charged is forcibly shifted from its target value.

In contrast, the configuration of the present embodiment can overcome such a difficult situation. When the energy coefficient KEn is lowered due to for example an increase in the number of times of successive injection or a decrease in the voltage of the DC-DC converter 34, adjustment is made such that, as shown in the third stage of FIG. 6A (refer to the solid line), the "on" period given to the charging switch SW2 is controlled to a longer time. In the opposite case to the above, where the energy coefficient KEn increases due to for example an increase in the voltage of the battery 8 and/or the DC-DC converter 34, adjustment according to the solid line in the third stage of FIG. 6B is made such that the "on" period given to the charging switch SW2 becomes shorter.

In this way, in the process for charging the piezoelectric elements P, the "on" time given to the charging switch SW2 is corrected (or adjusted) in the manner exemplified with FIGS. 6A and 6B. This correction responds to a change in the capacitance of the piezoelectric elements P, a change in voltage applied to the piezoelectric elements P, and/or individual differences (differences of the products) of the injector driving apparatus 20 and/or the injectors 10.

When the "on" time is corrected, it is possible to overcome the various difficult situations. The piezoelectric elements P can be charged in such a controlled manner that a difference (shift) between a target value for charged amounts and an actually charged amount in the piezoelectric elements P is decreased.

Accordingly, the amount of fuel actually injected from each injector 10 can be made equal or very close to the target amount, improving the precision of fuel injection from the injectors 10.

In the present embodiment, when the successive fuel injection should be performed, the energy coefficient Kn is corrected (adjusted) to increase more than the present value. This allows the "on" period of the charging switch SW2 to be longer than the case with no successive fuel injection. It is thus possible to prevent the amount of electric energy actually accumulated in the piezoelectric elements P from being less than the target value.

Specifically, the terminal voltage of the battery 8, interval information about the voltage of the DC-DC converter 34, and the successive injection number-of-times information are acquired. The acquired information is made with reference to the maps explained with FIGS. 4C-4F to estimate the influence of the successive fuel injection. Thus it is possible to correct the target value so as to prevent a situation where the amount of electric energy actually accumulated in the piezoelectric elements P, which is due to the successive fuel injection, is made less than the target value.

In addition, the present embodiment adopts the maps exemplified in FIGS. 4A and 4B, with which the "on" period given to the charging switch SW2 is corrected in accordance with the temperatures of the EDU 30 and injectors 10. Thus it is possible to prevent a situation where the actually injected fuel amount is made to differ from the target value on account of such fluctuations in the temperatures of the EDU 30 and injectors 10.

The injector driving apparatus 20 according to the present embodiment employs another configuration where the temperatures of the EDU 30 and injectors 10 are estimated on the detected signals from the on-vehicle various sensors 60-65, without actual measurement. Information indicting such temperatures can therefore be obtained with the use of the existing components, with no installation of new components dedicated to the temperature measurement.

In the injector driving apparatus 20 according to the present embodiment, the open-loop control is adopted to correct the "on" period given to the charging switch SW2. It is therefore possible to simplify the correcting processing (i.e., steps S110-S150) for correcting the "on" period.

Second Embodiment

Figure 7:
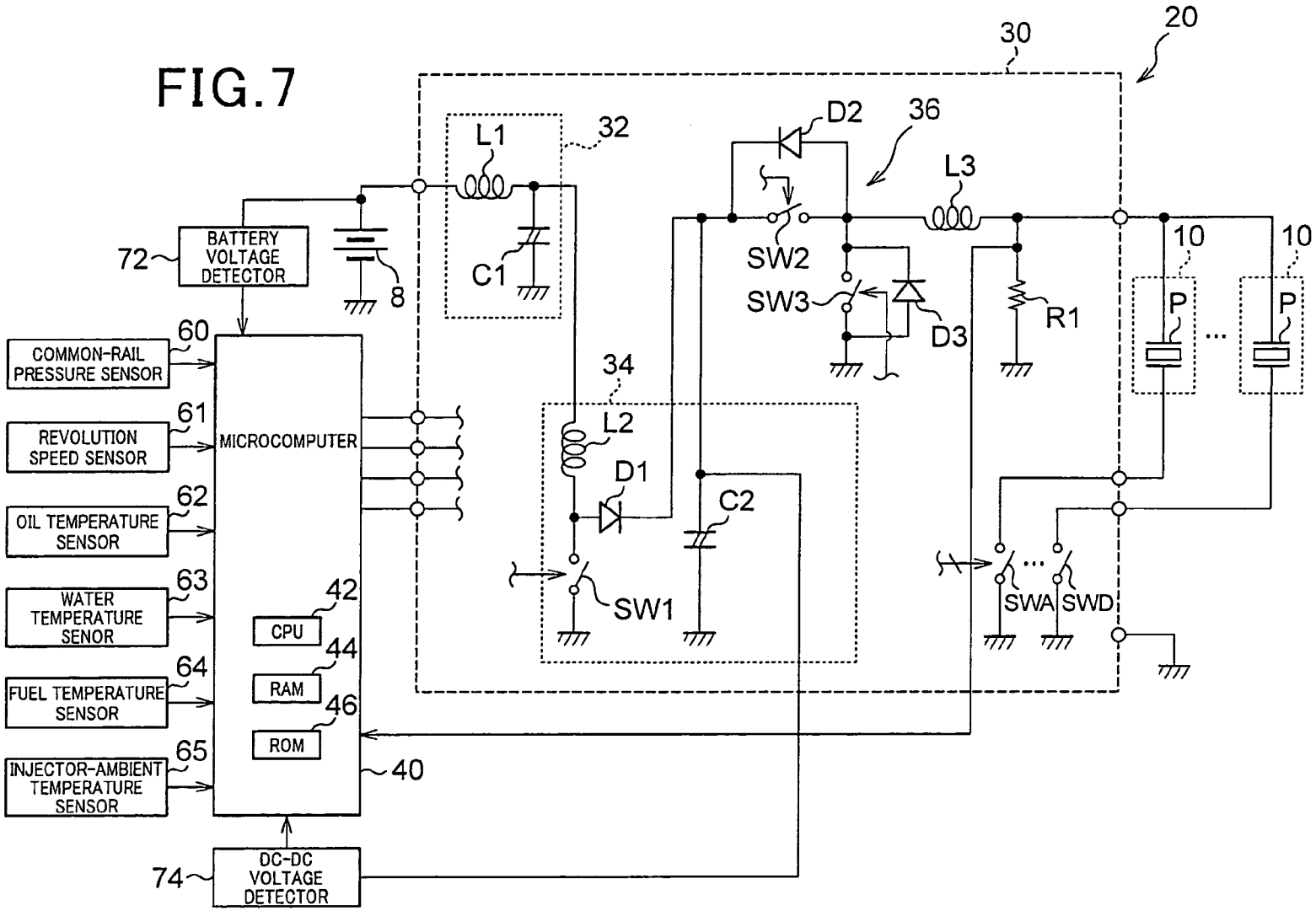
FIG. 7 is a circuit diagram showing an injector driving system according to a second embodiment of the present invention.

Referring now to FIG. 7, a second embodiment of the injector driving apparatus according to the present invention will be described.

As described before, an amount of electric energy E to be accumulated in each piezoelectric element P is expressed by $E=(1/2)(CV)^2$. Thus when the voltage V applied to each piezoelectric element P and the capacitance C of each piezoelectric element P are found, the energy amount E can be controlled.

The second embodiment is directed to another way to correct the "on" period of the charging switch SW2. In the first embodiment, the "on" period is corrected so that the electric energy at each piezoelectric element P is controlled at a desired target value. In contrast, in the second embodiment, the "on" period is corrected so that each piezoelectric element P is subjected to application of a desired voltage value.

FIG. 7 shows the electric configuration of the injector driving apparatus according to the second embodiment.

As shown in FIG. 7, the EDU 30 is additionally equipped with a resistor R1 for detecting the voltage. One end of the resistor R1 is electrically connected to not only the line connecting the charging/discharging coil L3 and the piezoelectric elements P but also the microcomputer 40, while the other end thereof is grounded. Thus the microcomputer 40 is able to detect the voltage applied to the piezoelectric elements P (injectors 10) by using the voltage detected from the resistor R1.

The remaining configurations are the same as those in the first embodiment.

In the similar way to the first embodiment, the configuration of the second embodiment enables the charging control for the piezoelectric elements P. During the charging control, the capacitance of each piezoelectric element P, fluctuations in the voltage applied to each piezoelectric element P, and/or individual differences of the injector driving apparatus 20 and/or injectors 10 are taken into consideration for correcting the "on" period. The precision of the fuel injection from the injectors 10 can be improved.

In addition, the voltage applied to the piezoelectric elements P is detected. As long as this voltage is detected, it is thus not necessary to obtain fluctuations in this voltage. Therefore, it is not necessary to store data showing the battery voltage map shown in FIG. 4C and the DC-DC voltage map shown in FIG. 4D into the ROM 46.

Third Embodiment

Figure 8:
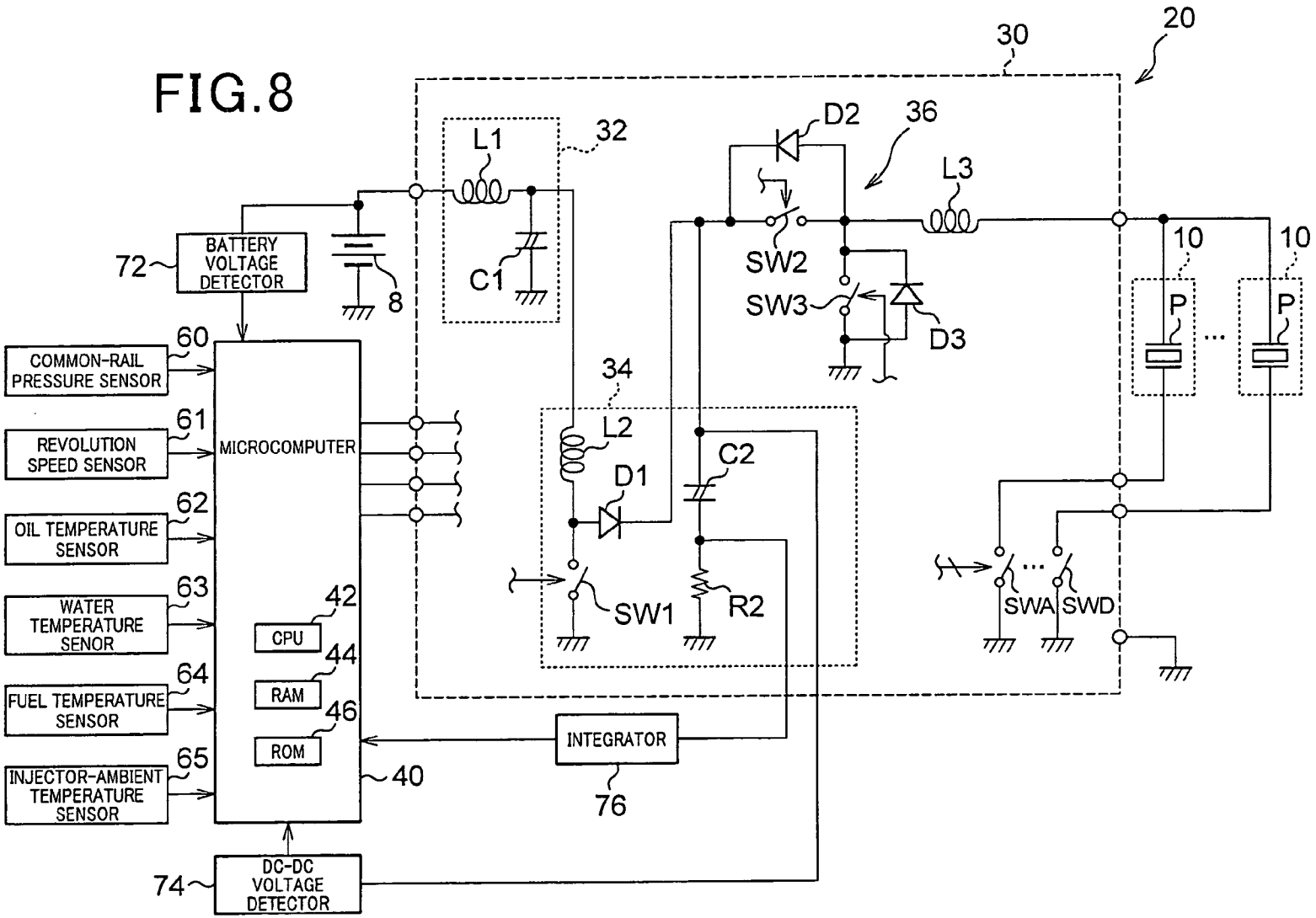
FIG. 8 is a circuit diagram showing an injector driving system according to a third embodiment of the present invention.

Referring now to FIG. 8, an injector driving apparatus according to a third embodiment of the present invention will now be described.

The foregoing formula $E=(1/2)(CV)^2$ can be transformed into a formula of $E=(1/2)QV$, wherein Q denotes electric charge accumulated at the piezoelectric element.

In the third embodiment, based on the above, the "on" period of the charting switch SW2 is corrected so that a desired amount of electric charge is accumulated at each piezoelectric element P.

FIG. 8 shows the configuration of the injector driving apparatus according to the third embodiment.

As shown in FIG. 8, this apparatus is additionally provided with a resistor R2 to detect current and an integrator 76. The resistor R2 is inserted in series between the DC-DC capacitor C2 and the ground. The capacitor-side terminal of the resistor R2 is connected to the microcomputer 40 via the integrator 76, which integrates current detected by the resistor R2 to detect the amount of electric charge accumulated at each piezoelectric element P (i.e., each injector).

In a similar way to the first embodiment, the configuration of the third embodiment enables the charging control for the piezoelectric elements P. During the charging control, the capacitance of each piezoelectric element P, fluctuations in the voltage applied to each piezoelectric element P, and/or individual differences of the injector driving apparatus 20 and/or injectors 10 are taken into consideration for correcting the "on" period. The precision of the fuel injection from the injectors 10 can be improved.

In the third embodiment, the amount of electric charge accumulated at each piezoelectric element P is detected, so that as long as this detected result is provided, it is not necessary to obtain fluctuations in the accumulated electric charge, that is, fluctuations in the capacitance. In such a case, it is not necessary to estimate the temperatures of the EDU 30 and injectors 10.

In other words, the energy E accumulated in each piezoelectric element P is expressed by $E=(1/2)QV$, so that, provided that the electric charge Q is detected, simply obtaining fluctuations in the voltage makes it possible that the actually charged energy is controlled to a target value with a minimum value.

MODIFICATIONS

The foregoing embodiments can still be modified as follows. The foregoing embodiments have been explained as a case where the one vehicle is provided with the one EDU 30. However this is not a definive list. The one vehicle can be provided with a plurality of EDUs 30. In this case, it is sufficient that there is provided with an EDU command map in which individual differences are stored EDU by EDU.

Another modification is concerned with acquisition of the wire information. In the foregoing embodiments, when installing the injectors 10 and injector driving apparatus 20 into the vehicle, the wire information is acquired by measurement. However, this is just an example. Alternatively, prior to shipping the injectors 10 and injector driving apparatus 20, vehicle information including the wire information is acquired, and, from the acquired information, the wire information is memorized in a QR (Quick Response) Code®.

Another modification is concerned with detection of the resistance of the wires connecting the EDU 30 and the injectors 10. Such a resistance value may be detected by measuring a voltage generated in a response to a flow of a minute reference current in the injector driving system.

In the foregoing embodiments, the description has been given to the case where the common-rail type of four-cylinder engine 2 is mounted as a drive source on the vehicle. However the drive source may be a gasoline-powered engine.

Throughout the foregoing embodiments and modifications, the advantageous operations according to the present invention are obtained as follows.

The command value is corrected on the basis of information indicating either an operation of the piezoelectric element or an electric characteristic of the apparatus. The piezoelectric element can be charged so that, even if the capacitance of the piezoelectric element and/of the voltage applied to the piezoelectric element fluctuate, an amount of electric energy actually accumulated (charged) in the piezoelectric element does not differ from the command value. The command value indicates a target amount of electric energy to be accumulated at the piezoelectric element.

Alternatively, the command value can also be corrected based on the information indicating a characteristic of the apparatus. Thus, even if there are irregularities in the characteristics of products (individual differences), the amount of electronic energy accumulated at the piezoelectric element can be controlled accurately to a target command value.

Accordingly, the amount of fuel injected actually from the injector becomes equal or almost equal to a target amount of fuel to be injected, providing a more precise fuel injection. This is a primary advantage to the present invention.

Preferably, the command value (control amount) is increased to cancel the influence of the successive fuel injection. Hence it is preventable that the electric energy charged in the piezoelectric element runs short from its target value. It is thus possible that a difference between an amount of fuel to be injected and an amount of fuel which has been injected actually can be reduced or eliminated. This primary advantage is gained when the voltage of the power supply to the piezoelectric element fluctuates. This primary advantage is also true of even the voltage of the external power supply powering the power supply to the piezoelectric element and/or the characteristics of injecting the operations of the injector. The temperature of the injector driving apparatus is considered in correcting the control amount to gain the above advantage. The temperature can be estimated on calculation, not limited to the direct measurement.

The above primary advantage can also be gained on the operating conditions and the temperature of the injector itself. The temperature of the injector is directly measured or estimated on calculation.

The command value can also be corrected on information indicating the characteristics of the apparatus, thus providing the foregoing primary advantage. This information includes various factors such as resistance and/or inductance of wirings connecting the charger and the injector, capacitance of the piezoelectric element, serial resistance component to the injector, and/or electric characteristics of each terminal to connect the charger and the injector. The correction on these factors also provides the foregoing advantage.

The present invention may be embodied in several other forms without departing from the spirit thereof. The embodiments and modifications described so far are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. An apparatus for driving an injector injecting fuel into an internal combustion engine, the injector being provided with a piezoelectric element to be charged and discharged, the apparatus comprising:

a charger that charges the piezoelectric element in response to a command value to accumulate a desired amount of electric energy at the piezoelectric element;

an acquiring unit that acquires information indicating at least a voltage applied to the piezoelectric element;

a calculator that calculates the command value, wherein the calculator includes correcting means that uses the information to correct the command value by increasing the command value so as to cancel an influence of successive fuel injection carried out by the injector, when the injector injects the fuel successively a plurality of times during one air-intake stroke carried out by each cylinder of the internal combustion engine, the influence of successive fuel injection being a shortage in the electric energy to be charged at the piezoelectric element compared to the desired amount of the electric energy; and a power source circuit that drives the charger in response to the corrected command value such that the charger charges the piezoelectric element in response to the corrected command value.

2. The apparatus of claim 1, comprising a memory device that memorizes interval information indicating intervals between fuel injection operations of the injector, wherein the acquiring unit is adapted to additionally acquire, as an additional part of the information, the interval information memorized in the memory device.

3. The apparatus of claim 1, comprising a memory device that memorizes information indicating the number of times of successive fuel injections of the injector, wherein the acquiring unit is adapted to additionally acquire, as an additional part of the information, the information indicating the number of times memorized in the memory device.

4. An apparatus for driving an injector injecting fuel into an internal combustion engine, the injector being provided with a piezoelectric element to be charged and discharged, the apparatus comprising:

a charger that charges the piezoelectric element in response to a command value to accumulate a desired amount of electric energy at the piezoelectric element;

a power source circuit including a charging capacitor that supplies power to the charger to give the electric energy to the piezoelectric element;

a power voltage detector that detects a voltage of the power source circuit;

an acquiring unit that acquires information indicating the voltage of the power source circuit from the power voltage detector;

a calculator that calculates the command value to charge the piezoelectric element, wherein the calculator includes correcting means that corrects the command value based on the acquired information when the injector injects the fuel successively a plurality of times during one air-intake stroke carried out by each cylinder of the internal combustion engine, the influence of successive fuel injection being a shortage in the electric energy to be charged at the piezoelectric element compared to the desired amount of the electric energy, so that a corrected command value is given, as the command value, to the power source circuit.

5. The apparatus of claim 4, comprising a battery that is electrically connected to the power source circuit so as to power the power source circuit; and a battery voltage detector that detects a voltage of the battery, wherein the acquiring unit is adapted to additionally acquire, as an additional part of the information, information indicating the voltage of the battery as well as the voltage of the power source circuit.

6. The apparatus of claim 4, further comprising a memory device that memorizes interval information indicating intervals between fuel injection operations of the injector, wherein the acquiring unit is adapted to additionally acquire, as an additional part of the information, the interval information memorized in the memory device.

7. The apparatus of claim 4, further comprising a memory device that memorizes information indicating the number of times of successive fuel injections of the injector, wherein the acquiring unit is adapted to additionally acquire, as an additional part of the information, information indicating the number of times memorized in the memory device.

8. An apparatus for driving an injector injecting fuel into an internal combustion engine, the injector being provided with a piezoelectric element to be charged and discharged, the apparatus comprising:

a charger that charges the piezoelectric element in response to a command value to accumulate a desired amount of electric energy at the piezoelectric element;

an acquiring unit that acquires, information indicating temperature relevant to the apparatus, wherein the acquiring unit includes a temperature obtaining unit adapted to obtain temperature of a circuit equipped with both the charger and a power source circuit that supplies power to the charger in response to the command value; and a calculator that calculates the command value, wherein the calculator includes correcting means that corrects the command value based on the acquired information when the injector injects the fuel successively a plurality of times during one air-intake stroke carried out by each cylinder of the internal combustion engine, the influence of successive fuel injection being a shortage in the electric energy to be charged at the piezoelectric element compared to the desired amount of the electric energy, so that the corrected command value is given, as the command value, to the power source circuit.

9. The apparatus of claim 8, wherein the temperature obtaining unit is adapted to estimate the temperature of the circuit for driving the injector based on operated conditions of the internal combustion engine.

10. The apparatus of claim 9, wherein the temperature obtaining unit is adapted to estimate the temperature of the circuit based on at least one of bits of information indicating the number of times of operations of the injector per unit time, a temperature surrounding the injector, a temperature of cooling water of the internal combustion engine, a temperature of lubricant of the internal combustion engine, and a temperature of the internal combustion engine.

* * * * *